US011628990B2

(12) United States Patent
Chambers

(10) Patent No.: US 11,628,990 B2
(45) Date of Patent: Apr. 18, 2023

(54) LOCKING PACKAGING CONTAINER

(71) Applicant: All Packaging Company, Aurora, CO (US)

(72) Inventor: Christopher Chambers, Aurora, CO (US)

(73) Assignee: All Packaging Company, Aurora, CO (US)

( * ) Notice: Subject to any disclaimer, the term of this patent is extended or adjusted under 35 U.S.C. 154(b) by 0 days.

(21) Appl. No.: 17/071,884

(22) Filed: Oct. 15, 2020

(65) Prior Publication Data

US 2021/0107712 A1 Apr. 15, 2021

Related U.S. Application Data

(60) Provisional application No. 62/915,602, filed on Oct. 15, 2019.

(51) Int. Cl.
*B65D 50/06* (2006.01)
*B65D 5/38* (2006.01)

(52) U.S. Cl.
CPC ..... *B65D 50/066* (2013.01); *B65D 5/38* (2013.01); *B65D 2215/04* (2013.01); *B65D 2255/20* (2013.01)

(58) Field of Classification Search
CPC .... B65D 50/066; B65D 5/38; B65D 2215/04; B65D 2255/20
USPC ..... 206/1.5, 531, 532, 528
See application file for complete search history.

(56) References Cited

U.S. PATENT DOCUMENTS 7,658,287 B2 * 2/2010 Hession ..... B65D 83/0463 206/528
8,939,281 B2 * 1/2015 Matsuba ..... B65D 25/00 206/459.1
9,475,605 B2 * 10/2016 Everett ..... B65D 59/04
2007/0251983 A1 * 11/2007 Freeze ..... A61J 7/0069 229/125.125
2012/0234701 A1 * 9/2012 Albrecht ..... B65D 83/0463 206/1.5
2013/0140201 A1 6/2013 Ghini et al.
2016/0001937 A1 1/2016 Skinner
2017/0036808 A1 2/2017 Everett
(Continued)

FOREIGN PATENT DOCUMENTS

JP 3216684 U 6/2018

OTHER PUBLICATIONS

International Search Report and Written Opinion received for PCT Patent Application No. PCT/US2020/055842, dated Jan. 19, 2021, 11 pages.

*Primary Examiner* — Rafael A Ortiz
*Assistant Examiner* — Sanjidul Islam
(74) *Attorney, Agent, or Firm* — Holland & Hart LLP

(57) ABSTRACT

The technology disclosed herein includes a re-lockable, environmentally friendly packaging apparatus including an outer sleeve, an inner sleeve, and at least one locking mechanism configured to lock the inner sleeve inside the outer sleeve. In some implementations, the locking mechanism is an interior mechanism, which locks the inner sleeve in its entirety in the outer sleeve. In some implementations, the locking mechanism is an interior sliding mechanism, which permits the inner sleeve to move partially out of the outer sleeve. In some implementations, the inner sleeve includes a pull tab for removal of the inner sleeve from inside the outer sleeve.

20 Claims, 10 Drawing Sheets

(56) References Cited

U.S. PATENT DOCUMENTS

| | | | | |
|---|---|---|---|---|
| 2017/0297803 | A1* | 10/2017 | Chambers | B65D 5/5035 |
| 2018/0072452 | A1 | 3/2018 | Chambers | |
| 2019/0084740 | A1 | 3/2019 | Davis et al. | |
| 2019/0233158 | A1* | 8/2019 | Jones | B31B 50/26 |
| 2020/0180808 | A1* | 6/2020 | Gauvin | B65D 5/38 |
| 2021/0016939 | A1* | 1/2021 | Palmer | B65D 5/38 |

* cited by examiner

LOCKING PACKAGING CONTAINER

CROSS-REFERENCE TO RELATED APPLICATION

This application claims the benefit of U.S. Provisional patent application No. 62/915,602, entitled "LOCKING PACKAGING CONTAINER," filed on Oct. 15, 2019, and is specifically incorporated by reference for all it discloses and teaches.

BACKGROUND

Cartons or other paperboard containers may be used for holding and storing items. In some implementations, the items held or stored in the containers may be harmful to certain users, such as children (e.g., a pharmaceutical drug, tobacco, etc.). A user may desire to hold or store items in a lockable, child-resistant container.

SUMMARY

The technology disclosed herein includes an environmentally friendly, re-lockable packaging apparatus comprising an outer sleeve, an inner sleeve, and at least one locking mechanism configured to lock the inner sleeve inside the outer sleeve, wherein a locking tab of the inner sleeve connected to a bottom panel of the inner sleeve is configured to move from a position in between and substantially parallel to the bottom panel of the inner sleeve and a middle panel of the outer sleeve to an angled position protruding into a first area of the outer sleeve proximate to a bottom panel of the outer sleeve and adjacent to the middle panel of the outer sleeve, and engage a locking ridge located on an end of the middle panel of the outer sleeve. The edge of the locking ridge and edge of the locking tab of the inner sleeve may be arc-shaped and the edge of the locking ridge and edge of the locking tab of the inner sleeve may be configured to oppose one another to form the first locking mechanism.

In some implementations, the packaging apparatus includes an aperture located on the bottom panel of the outer sleeve wherein a user can access the locking tab of the inner sleeve when the inner sleeve is positioned inside the outer sleeve in a closed configuration. The user can press the locking tab of the inner sleeve into the outer sleeve via the aperture and disengage the locking tab of the inner sleeve from the locking ridge to unlock the packaging apparatus. In some implementations, the first locking mechanism locks the inner sleeve in its entirety inside the outer sleeve.

In some implementations, the packaging apparatus includes a second locking mechanism of the packaging apparatus configured to lock the inner sleeve to the outer sleeve responsive to sliding the inner sleeve from the outer sleeve until the locking tab of the inner sleeve latches onto the locking tab of the outer sleeve. The locking tab of the inner sleeve and the locking tab of the outer sleeve may be angled in opposing directions. In some implementations, the second locking mechanism prevents the inner sleeve from sliding entirely out of the outer sleeve and/or locks the inner sleeve partially inside the outer sleeve.

In some implementations, the packaging apparatus includes a storage compartment located in the inner sleeve. In some implementations, the packaging apparatus includes at least one perforated top panel in the storage compartment, which may be pressed into the storage compartment to serve as a cradle or holder to receive and hold a storage item in place. The packaging apparatus may include a pull tab for removal of the inner sleeve from inside the outer sleeve. The packaging apparatus may include a permanently fixed dog-eared tuck located on an end of the outer sleeve.

In some implementations, the disclosed technology includes a packaging apparatus, which includes a method of sliding an inner sleeve into an outer sleeve of a packaging apparatus, moving a locking tab of the inner sleeve connected to a bottom panel of the inner sleeve from a position in between and substantially parallel to the bottom panel of the inner sleeve and a middle panel of the outer sleeve to an angled position protruding into a first area of the outer sleeve proximate to a bottom panel of the outer sleeve and adjacent to the middle panel of the outer sleeve, engaging the locking tab of the inner sleeve with a locking ridge located on an end of the middle panel of the outer sleeve, and locking the packaging apparatus responsive to engaging the locking tab of the inner sleeve with the locking ridge.

The method may further include pressing the locking tab of the inner sleeve into the outer sleeve via an aperture located in a bottom panel of the outer sleeve and disengaging the locking tab of the inner sleeve from the locking ridge to unlock the packaging apparatus. The method may further include sliding the inner sleeve from the outer sleeve, latching the locking tab of the inner sleeve onto a locking tab of the outer sleeve, and locking the inner sleeve to the outer sleeve responsive to latching the locking tab of the inner sleeve onto a locking tab of the outer sleeve. In some implementations, latching the locking tab of the inner sleeve onto a locking tab of the outer sleeve is responsive to the locking tab of the inner sleeve and the locking tab of the outer sleeve being angled in opposing directions.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various implementations as further illustrated in the accompanying drawings and defined in the appended claims.

These and various other features and advantages will be apparent from a reading of the following Detailed Description.

DETAILED DESCRIPTION

Figures 1A, 1B:
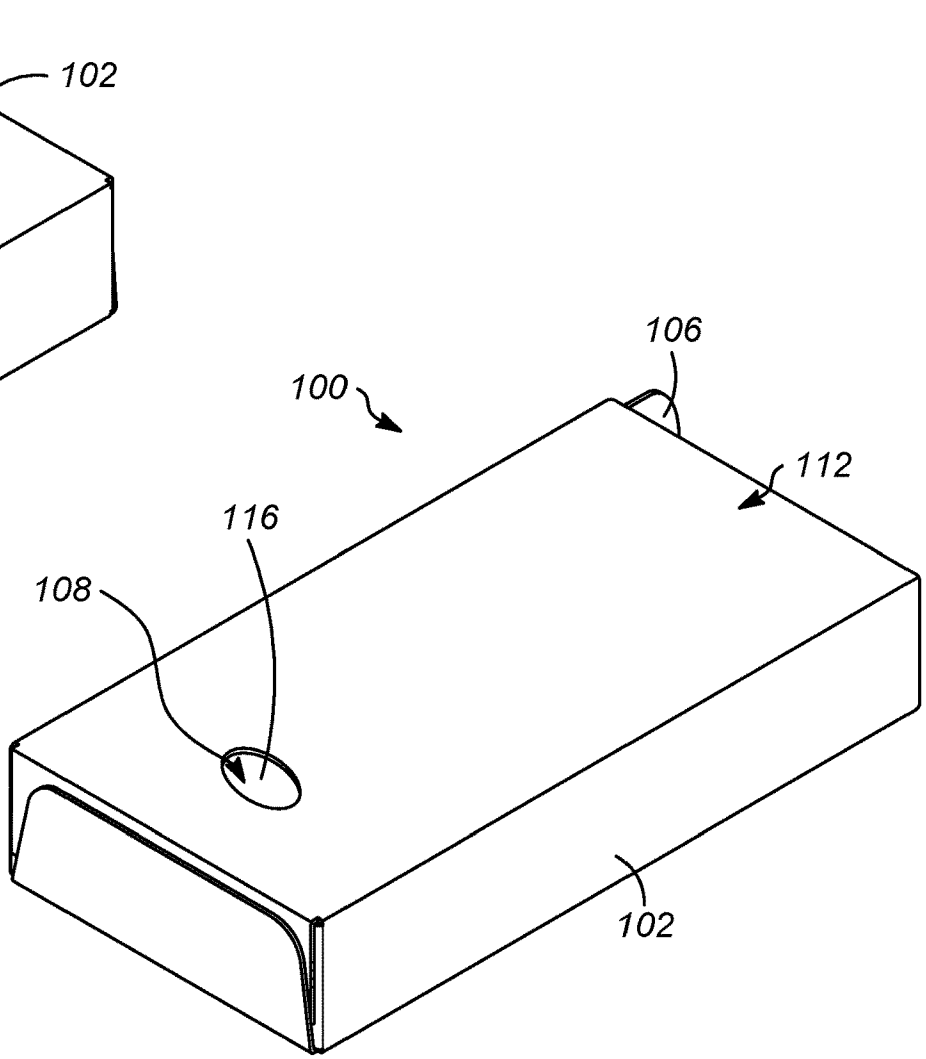
FIG. 1A illustrates a perspective top view of an example packaging apparatus in a closed position.
FIG. 1B illustrates a perspective bottom view of an example packaging apparatus in a closed position.

In the following description, for the purposes of explanation, numerous specific details are set forth in order to provide a thorough understanding of the present invention. It will be apparent, however, to one skilled in the art that the present invention may be practiced without some of these specific details. For example, while various features are ascribed to particular implementations, it should be appreciated that the features described with respect to one implementation may be incorporated with some implementations as well. Similarly, however, no single feature or features of any described implementation should be considered essential to the invention, as some implementations of the invention may omit such features.

For purposes of this disclosure, the term "substantially parallel" refers to a position wherein a tab lies sufficiently flat in relation to a first surface in an effort to slide between the first surface and a second surface opposing the first surface. For example, in some implementations, "substantially parallel" may be 0°-5° from the first surface.

For purposes of this disclosure, the term "locking" refers to a position wherein a tab is caught or latched onto another surface in an effort to prevent movement and create a locking mechanism as the tab is trapped in the latched position. For example, in some implementations, "locking" may mean a tab, for example, is prevented from movement because the tab is fighting against another surface when it is being pulled against the surface.

The disclosed technology includes packaging apparatuses configured to lock internally. In some implementations, the packaging apparatus may have a storage compartment, or an insert containing a compartment to hold, store, and secure an item. The packaging apparatus are child-resistant, easy to manufacture, and easy to use. In some implementations, the packaging apparatus are environmentally friendly and made of paperboard and have folding capabilities to reduce packaging. In some implementations, the packaging apparatus may be tamper-evident and/or senior-friendly. The packaging apparatus include panels, tabs, flaps, and apertures that may have various shapes (e.g., oval, rectangular, circular, etc.) depending on the intended use and manufacturing requirements (e.g., auto-erecting walls requirements). The panels, tabs, flaps, apertures, and other components of the packaging apparatus may have different locations in the packaging apparatus than what is shown in the figures. For example, a panel or tab may be moved in a packaging apparatus to accommodate better functioning of one of the disclosed locking mechanisms.

In some implementations, the panels, tabs, flaps, apertures, and other components of the packaging apparatus may have memory properties. Specifically, a locking tab may be able return to an original pre-bended shape or position after the locking tab is pressed in a certain direction. For example, if a paperboard locking tab has memory properties and is attached and extending from an end of a panel, and the paperboard locking tab is moved (or bent) around the end of the panel to be positioned substantially parallel on the panel and released, the locking tab will attempt to return or return to its original pre-bent shape or position.

FIG. 1A illustrates a perspective top view of an example packaging apparatus 100. The packaging apparatus 100 has an outer sleeve 102, an inner sleeve 104, and a pull tab 106. The pull tab 106 may be pulled by a user to pull the inner sleeve 104 from the outer sleeve 102 when the packaging apparatus 100 is in a closed position to open the packaging apparatus 100. In some implementations, the pull tab 106 may be configured to have a 'tear away' function. Specifically, there may be a cut located on both sides of the pull tab 106. If a child, for example, tries to get into the packaging apparatus 100 and forcefully grabs or pulls the pull tab 106, the tab 106 is configured to rip off or tear away. As a result, the packaging apparatus 100 is then tamper-evident, and the child will not be able to pull the inner sleeve 104 from the outer sleeve 102 via the pull tab 106.

FIG. 1B illustrates a perspective bottom view of the example packaging apparatus 100. The outer sleeve 102, the inner sleeve 104, and the pull tab 106 are shown. An aperture 108 is located in a bottom panel 112 in the outer sleeve. As shown, the aperture is oval-shaped. The oval shape is intended to accommodate for a user's finger to access inside the outer sleeve and to prevent tampering, which may occur with a square shape, for example. However, in other implementations, the aperture 108 may be other shapes. The size of the aperture is configured to be small enough to prevent a user's finger or fingernails from tearing the packaging apparatus. In some implementations, the aperture 108 may be approximately ½-inch wide and approximately ¼-inch tall, by way of example, but the sizes may vary.

When in the packaging apparatus 100 is in a closed position, the packaging apparatus 100 is locked, where the inner sleeve 104 is locked inside the outer sleeve 102. To open the packaging apparatus 100, a user can press downward on a locking tab on the inner sleeve 116 that is accessible via the aperture 108. When the locking tab 116 on the inner sleeve is pressed downward, the locking tab 116 on the inner sleeve moves and disengages from a locking ridge located on an interior middle panel (or glue lap) of the outer sleeve (shown and described in detail in FIGS. 4 and 5 below), and unlocks the inner sleeve 104 from the outer sleeve 102. The inner sleeve 104 can then be pulled from the outer sleeve 102.

As shown in FIG. 1B, the aperture 108 is located approximately ⅛ inch from an end of the outer sleeve 102. While the exact location and measurement of the aperture may vary, the location of the aperture in the bottom panel 112 is far enough from the end of the outer sleeve 102 that the locking tab of the inner sleeve 116 can be accessed and disengaged from a locking ridge, and close enough to the end of the outer sleeve 102 that a user (e.g., a child) cannot see the locking mechanism (the end of the locking tab of the inner sleeve interfacing the locking ridge).

In some implementations, the packaging apparatus 100 may have a second locking mechanism (described in detail in FIG. 4B below) that prevents the inner sleeve 104 from being pulled out its entirety out of the outer sleeve 102, and keeps the inner sleeve 104 connected to the outer sleeve 102.

Figure 1C:
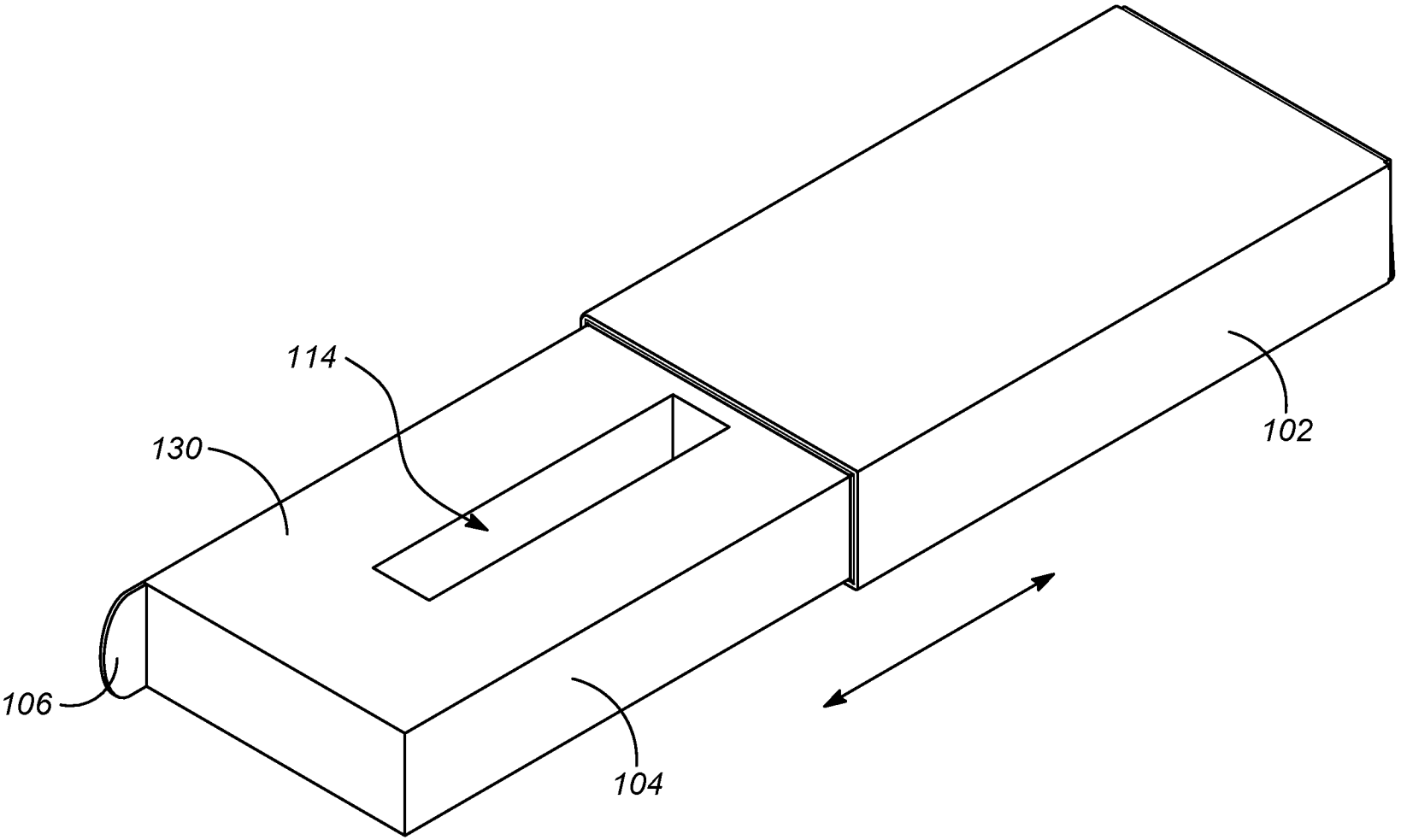
FIG. 1C illustrates a perspective top view of an example packaging apparatus in an open position.

Referring to FIG. 1C, the packaging apparatus 100 is shown in an open position where the inner sleeve 104 is connected to the outer sleeve 102. The arrow shows the direction that the inner sleeve 104 may be moved in and out of the outer sleeve 102. In some implementations, the inner sleeve 104 may be connected to the outer sleeve 102 via a second locking mechanism. The pull tab 106 connected to the inner sleeve 104 is shown.

The inner sleeve 104 has an inner sleeve compartment 114 located in a top panel 130 which acts as a storage compartment for holding items in place and for storing items in the outer sleeve 102. The inner sleeve compartment 114 can vary in design, size, and shape depending on the design and use of the packaging apparatus 100, as well as the required design for desired items to be stored in the outer sleeve 102. For example, the inner sleeve compartment 114 may be designed to securely hold vials, bottles, a vape cartridge, electronic cigarettes, food products, other objects, etc. in place. In some implementations, there may be multiple compartments. The inner sleeve compartment 114 may be defined by a number of panels configured in a single sheet of stock or packaging that makes up the inner sleeve 104 (shown and described in FIG. 3B).

Specifically, the compartment panels (top compartment panels, a compartment bottom panel, compartment side panels, and a middle panel of the inner sleeve) are located adjacent to exterior inner sleeve panels in a sheet of stock and configure to make the inner sleeve compartment 114. The compartment panels can form side walls, a top panel of the inner sleeve compartment 114, and a bottom panel of the inner sleeve compartment 114 that are positioned over the middle panel of the inner sleeve. Once the inner sleeve compartment 114 is constructed, the two compartment side panels form partitions in the inner sleeve 104 that form three tube-like compartments that run the length of the inner sleeve as well as add two additional walls in the inner sleeve 104 for added structural integrity. One of the tube-like compartments becomes the inner sleeve compartment and the other two tube-like compartments are not accessible from the outside of the packaging apparatus. In some implementations, the inner sleeve does not have an end panel and the three compartments are open, to conserve on packaging material. This open end of the inner sleeve faces inside the outer sleeve when the inner sleeve is inserted into the outer sleeve.

Contents or storage items are stored in the inner sleeve compartment 114. In some implementations, contents may be kept in place by a perforated top panel (e.g., see perforated top panel 368 in FIG. 3B). For example, the perforated top panel may be configured to separate in the middle (e.g., the line in the middle of the panel) into two separate pieces or panels and bend at various desired perforations (e.g., at one or more of the other six perforation lines shown) into the inner compartment 114 to create an automatic cradle and secure fitting for a content to be stored.

In some implementations, there may be one or more aperture located in the top panel(s) 368 to receive a storage item to further secure it in place in the inner sleeve compartment 114. The top panel(s) 368 may be configured to move down into the inner sleeve compartment adjacent to the inner compartment sidewalls 376*a* and 376*b*, and in some implementations, contacting a bottom panel of the compartment 384.

The components of the packaging apparatus 100 can comprise of one or more materials (i.e., paperboard, wax paper, aluminum foil, cellophane, plastic, thermoformed plastic material such as polystyrenes, polypropylenes, polyethylenes, polyethylene terephthalates, polyvinyl chloride polystyrenes, polyvinylydene chlorides, fluoride resins, polycarbonates, polyamides, polyphenylene oxides, and combinations thereof, etc.), and of varying measurements, depending on the storage requirements for the storage items. For example, in some implementations, all of the packaging apparatus 100 may be paperboard of varying thickness. In some implementations, the interior walls of the outer sleeve 102 may have a lining or tray made of a material different than the outer sleeve 102. For example, the outer sleeve 102 may be made of paperboard, and a lining on the interior walls of the outer sleeve 102 may be plastic or another material that cannot be ripped or torn, reinforcing the child-resistant nature of the packaging apparatus 100. Or, in another implementation, the inner sleeve 104 may be made of both a plastic material and a paperboard material to provide additional durability.

In some implementations, the packaging apparatus may include silicone to minimize the risk of moisture build-up, or parchment paper if storage items are sticky, or other materials which may provide an airtight or moisture-free environment or prevent freezing or other temperature change. Other materials are contemplated that prevent against moisture and humidity, direct light, sources of heat, contamination, mildew or mold, and bugs.

In some implementations, scoring of the components may allow for memory, and different thicknesses of material may be used for rigidity. In some implementations, plastic laminate may be included in the packaging apparatus so that the packaging is tear-proof.

In some implementations, the packaging apparatus includes at least one additional interior locking mechanism (described in detail in FIG. 4) configured to lock the inner sleeve 104 to the outer sleeve 102 in both open and closed configurations.

Figure 2A:
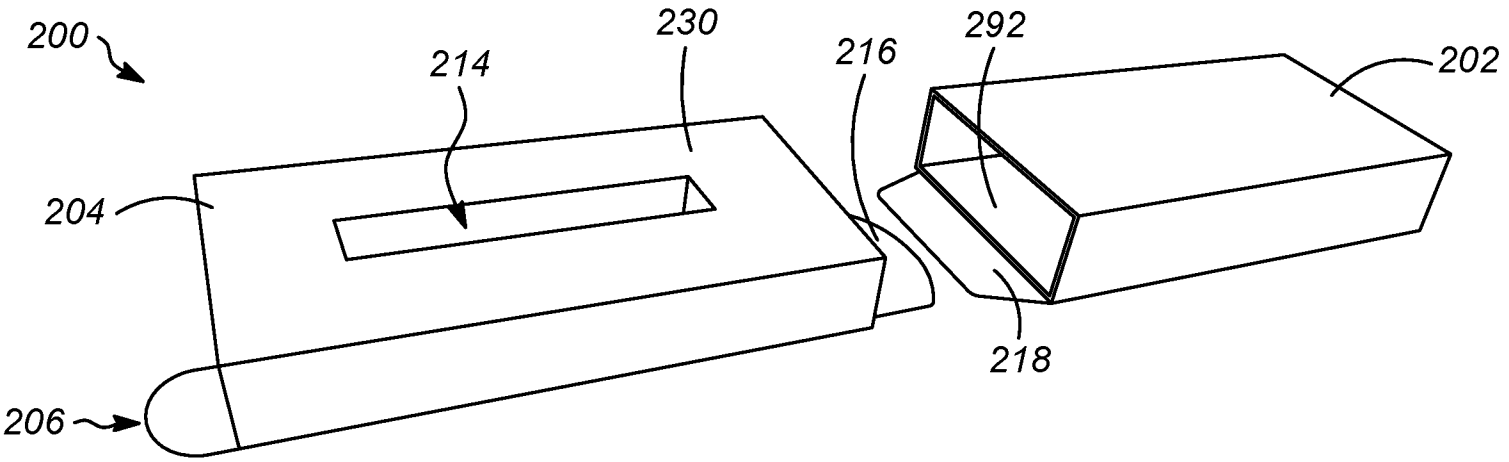
FIGS. 2A-D illustrates perspective views of an example packaging apparatus during assembly.

FIGS. 2A-D illustrate perspective views of example packaging apparatus 200 during assembly. FIG. 2A illustrates the outer sleeve 202 separated from the inner sleeve 204 before assembly. A locking tab 218 on the outer sleeve 202 is connected to an end of the bottom panel of the outer sleeve 212. The inner sleeve 204 has an inner sleeve compartment 214 shown in the top panel of the inner sleeve 230. A locking tab on the inner sleeve 216 is connected to an end of the inner sleeve 204. A pull tab 206 is also shown on the inner sleeve 204.

Figure 2B:
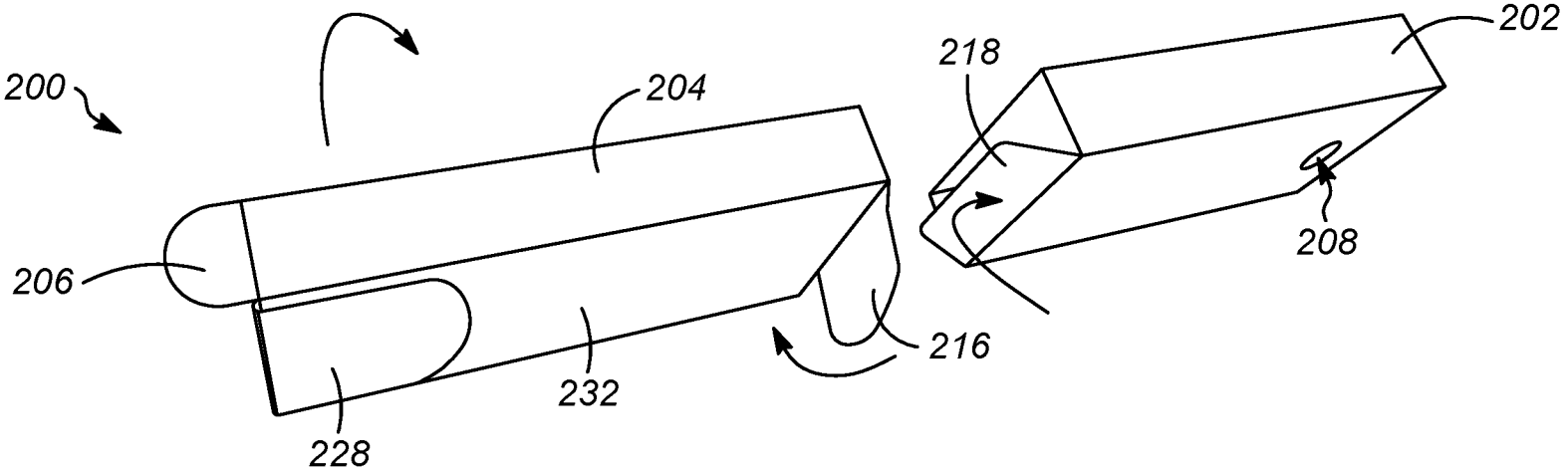

FIG. 2B illustrates that the locking tab of the inner sleeve 216 connected to the inner sleeve 204 may be pressed down and rotated around, or backward, in a direction to lay approximately adjacent or substantially parallel to an exterior surface of a bottom panel of the inner sleeve 204. The locking tab of the outer sleeve 218 located on the end of the outer sleeve 202 may be moved upward and pressed into the inside of the outer sleeve 208 to lay approximately adjacent or substantially parallel to the interior surface of a panel (e.g., see a glue lap or middle panel 392 located on the bottom panel, shown in FIG. 2A) of the outer sleeve 202. Once the inner sleeve 204 is fully inserted into the outer sleeve 202, a first locking mechanism locks the inner sleeve 204 inside the outer sleeve 202.

Figure 2C:
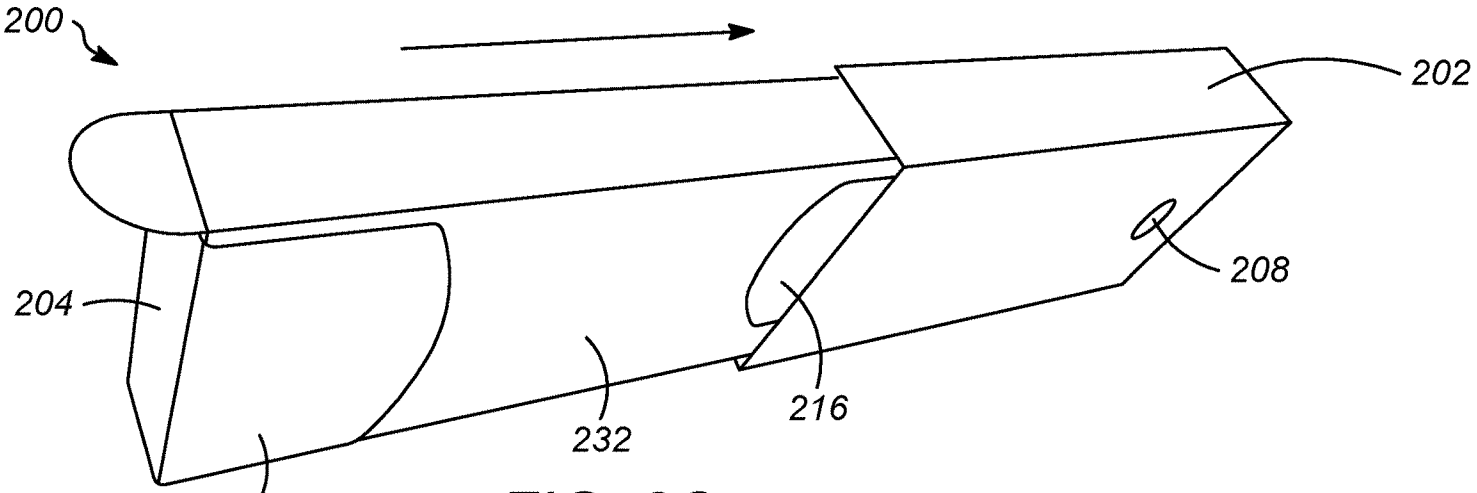

FIG. 2C illustrates the inner sleeve 204 being inserted into the outer sleeve 202, as the locking tab of the inner sleeve 216 connected to the inner sleeve 204 is positioned approximately adjacent or substantially parallel to a bottom panel 232 of the inner sleeve 204, and the locking tab of the outer sleeve 218 on the outer sleeve 202 is positioned inside the outer sleeve 202 approximately adjacent or substantially parallel to a glue lap or middle panel of the outer sleeve (not shown) located on the interior surface of a bottom panel of the outer sleeve 202.

Figure 2D:
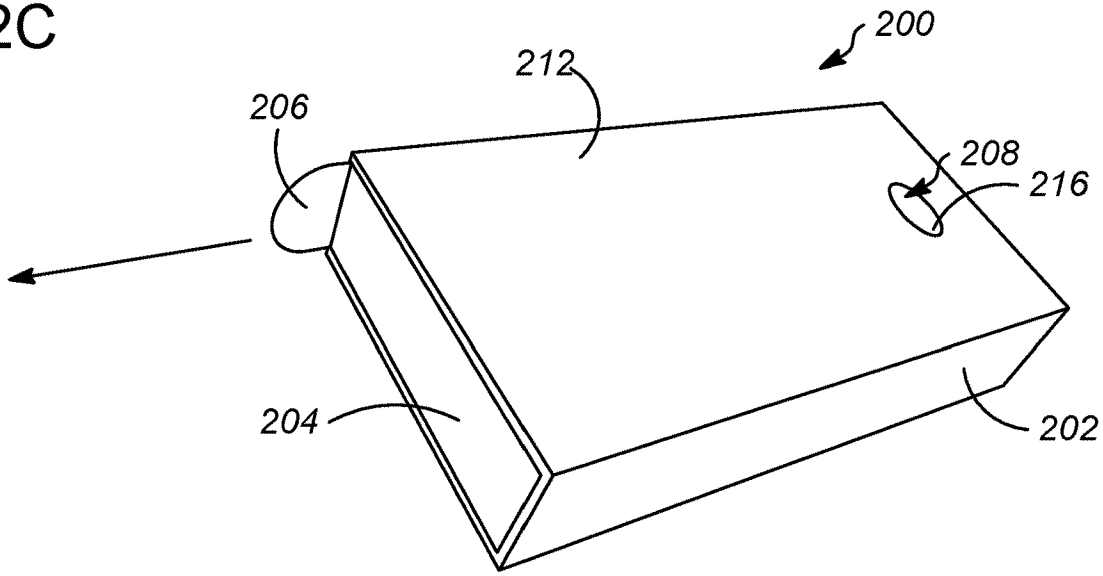

FIG. 2D illustrates the inner sleeve 204 inserted in the outer sleeve 202. The locking tab of the inner sleeve 216 connected to the inner sleeve 204 is shown accessible through the aperture 208 located in the bottom panel of the outer sleeve 212. To open the packaging apparatus 200, a user can unlock the locking tab of the inner sleeve and pull the pull tab 206 of the inner sleeve 204 to slide the inner sleeve 204 from the outer sleeve 206.

Figure 3A:
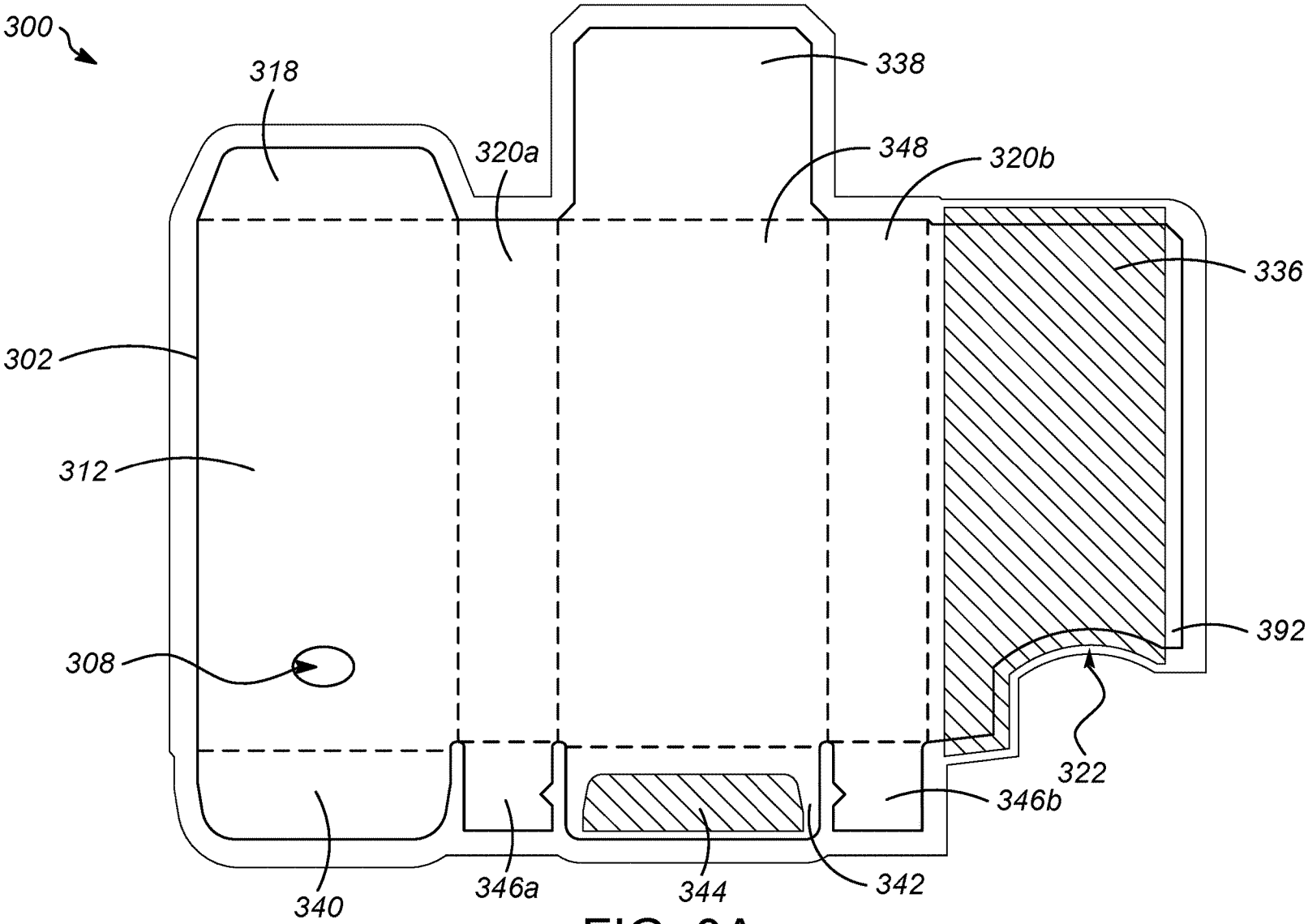
FIG. 3A illustrates a plan view of an unassembled example outer sleeve of a packaging apparatus.

FIG. 3A illustrates a plan view of an unassembled example outer sleeve 302 of a packaging apparatus 300. The plan view of the outer sleeve 302 is an example, and there may be variations on how the outer sleeve 302 is assembled.

The outer sleeve 302 includes several panels that can be folded onto each other to create rectangular packaging with one open end. As shown, the unassembled example outer sleeve 302 is a single sheet of packaging material that includes panels, tabs and dust flaps.

A first layer of adhesive of the outer sleeve 336 is shown as applied to a first glue lap 292 (shown in FIG. 2) and 392, an interior panel of the outer sleeve 302. A "glue lap" may be referred to as a packaging panel or extra stock in which glue or other adhesive is applied in order to attach the glue lap to another panel or surface in the packaging apparatus 300. Glue laps may be added to packaging for various reasons, including for extra reinforcement to packaging, to create compartments, and to act as locking mechanisms. For purposes of this disclosure, a glue lap may also be defined as a particular panel. For example, the first glue lap 392 is also the middle panel in the outer sleeve 302. As described below, during assembly, the first glue lap 392 folds onto the bottom panel 312 of the outer sleeve 302 and the first layer of adhesive of the outer sleeve 336 seals the first glue lap 392 onto the interior surface of the bottom panel of the outer sleeve 312. As shown in the figures and described herein, a "layer of adhesive" is depicted as where the layer of adhesive is applied on a given panel of the single sheet of packaging material, and the area upon which the panel will seal to another panel or packaging surface.

The locking tab of the outer sleeve 318 is connected to an end of the bottom panel of the outer sleeve 312. The locking tab of the outer sleeve 318 has memory properties. During use of the packaging apparatus 300, the locking tab of the outer sleeve 318 may be moved inside the outer sleeve 302 to form part of a second locking mechanism when the inner sleeve 304 is moved from the outer sleeve 302 (described in detail in FIG. 4B).

A reinforcement panel of the outer sleeve 228 (shown in FIG. 2B), 338(shown in FIG. 3A), 428 (shown in FIG. 4A), and 528 (shown in FIG. 5A) may also be folded into the interior of the outer sleeve 302. In some implementations, the reinforcement panel of the outer sleeve 338 is glued against the top panel outer sleeve 348. The reinforcement panel of the outer sleeve 338 wraps around the end of the outer sleeve so that the edges of the outer sleeve 302 are rounded (rather than square), which prevents tampering of the packaging apparatus.

Dust flaps 346*a* and 346*b* are located adjacent to the side panels 320*a* and 320*b*. As shown, the dust flaps 346*a* and 346*b* have cut-outs for die-cutting to provide for clearance with adjacent panels and to decrease any gap size between panels once the end panels are folded during assembly.

To assemble the outer sleeve 302, the first glue lap of the outer sleeve 392 is folded into the outer sleeve 302, where the first glue lap of the outer sleeve 392 is located opposite the top panel of the outer sleeve 348 and the side panel 120*b* forms one side to the outer sleeve 302. The bottom panel of the outer sleeve 312 is folded on top of the first glue lap of the outer sleeve 392 attaching via the first adhesive of the outer sleeve 336. The side panel 120*a* forms a second side to the outer sleeve 302. The side panels 320*a* and 320*b* are perpendicular to the first glue lap of the outer sleeve 392, the bottom panel of the outer sleeve 312, and the top panel of the outer sleeve 348.

Once the outer walls (e.g., top panel of the outer sleeve 348, bottom panel of the outer sleeve 312, side panels 320*a* and 320*b*, and the first glue lap of the outer sleeve 392) are assembled, the dust flaps 346*a* and 346*b* are folded inside the outer sleeve 302, and a first end flap 340 is folded to close an end of the outer sleeve 302. A second glue lap 342 may be folded onto the first end flap 340 and secured to the first end flap 340 with a second layer of adhesive of the outer sleeve 344. The dust flap 346*a* and 346*b*, fourth flap 340, and second glue lap 342, in combination together, create a "dog-eared tuck" located on the end of the outer sleeve 302, which is a permanently fixed and child-resistant end of the packaging, which requires tearing to open the packaging apparatus 300 once it is closed and locked.

A locking ridge or edge 322 is configured on the first glue lap 392. A locking ridge or edge 322 is an edge located on the end of the first glue lap 392 proximate to the bottom panel of the outer sleeve 312. Once the packaging apparatus 300 is assembled, after the inner sleeve 304 is inserted into the outer sleeve 302, and during use, the packaging apparatus is in a closed configuration. A locking tab of the inner sleeve 316 can latch, engage, or otherwise "lock" onto the locking ridge 322 and lock the inner sleeve 304 inside the outer sleeve 302 (described in more detail below). When the locking tab of the inner sleeve 316 of the inner sleeve 304 has latched onto the locking ridge 322, a user is prevented from pulling the inner sleeve 304 out of the outer sleeve 302.

Figure 3B:
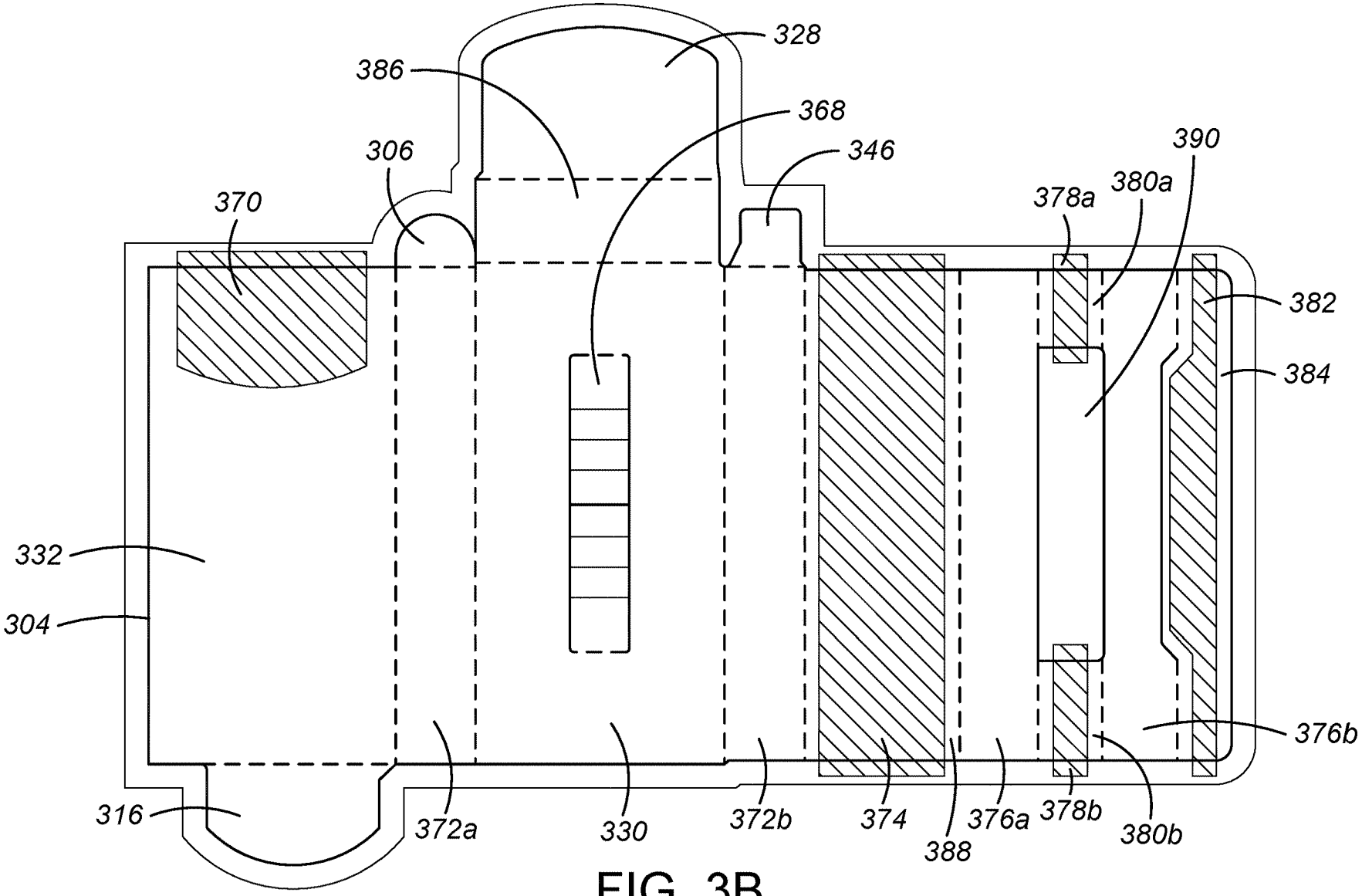
FIG. 3B illustrates a plan view of an unassembled example inner sleeve of a packaging apparatus.

FIG. 3B illustrates a plan view of an unassembled example inner sleeve of a packaging apparatus 300. The plan view of the inner sleeve 304 is an example, and there may be variations on how the inner sleeve 304 is assembled. The inner sleeve 304 includes several panels that can be folded onto each other to create rectangular packaging. In some implementations, the inner sleeve has one open end. As shown, the unassembled example inner sleeve 304 is a single sheet of packaging material that includes panels, tabs, and dust flaps.

A top panel of the inner sleeve 330 is shown with the bottom panel of the inner sleeve 332 with two side panels 372*a* and 372*b*. The bottom panel of the inner sleeve 332 is shown with a first adhesive of the inner sleeve 370 located on an end. The inner sleeve 304 has a pull tab 306, and an end panel of the inner sleeve 386. A locking tab of the inner sleeve 316 is shown attached to the end of the bottom panel of the inner sleeve 332. The reinforcement panel of the inner sleeve 328 is shown attached to an end panel of the inner sleeve 386, which is attached to the top panel of the inner sleeve 330. A compartment panel 368 is located in the top panel of the inner sleeve 330.

The side panel of the inner sleeve 372*b* is connected to components that make up the inner compartment 114, shown in FIG. 1C. Specifically, the side panel of the inner sleeve 372*b* is connected to a middle panel of the inner sleeve 388, which is shown with a second layer of adhesive of the inner sleeve 374. The middle panel of the inner sleeve 388 is connected to a compartment side wall 376*a*.

The compartment side panel 376*a* is connected to components compartment top panels 380*a* and 380*b*, which are separated from each other by a compartment aperture 390. Third layers of adhesive of the inner sleeve 378*a* and 378*b* are located on top of the two compartment top panels 380*a* and 380*b*, respectively. The two compartment top panels 380*a* and 380*b* are attached to a compartment side panel 376*b*, which is attached to a bottom panel of the compartment 384. A fourth layer of adhesive of the inner sleeve 382 is located on the bottom panel of the compartment 384.

When assembled, an inner sleeve compartment (e.g., inner sleeve compartment 114 shown in FIG. 1C) is created by the bottom panel of the compartment 384 folding or rolling into the inner sleeve 304 where the bottom panel of the compartment 384 attaches and seals via the fourth layer of adhesive of the inner sleeve 304 onto the middle panel of the inner sleeve 388. The middle panel of the inner sleeve 388 is folded and sealed onto the interior surface of the bottom panel of the inner sleeve 332 via the second layer of adhesive of the inner sleeve 374. The top panel of the inner sleeve 330 may be folded onto the top of the third layers of adhesive of the inner sleeve 378*a* and 378*b* securing the top panel of the inner sleeve 330 to the top panels of the compartment 380*a* and 380*b*.

The bottom panel of the inner sleeve 332 folds and seals onto middle panel of the inner sleeve 388 via a second adhesive of the inner sleeve 374.

The tab or dust flap 346 is then folded in toward the inside of the inner sleeve 304 and the end panel 386 of the inner sleeve 332 wraps around the tab 346. The reinforcement panel of the inner sleeve 328 wraps around to the exterior surface of the bottom panel of the inner sleeve attaching and sealing to the first layer of adhesive of the inner sleeve 370, sealing the end of the inner sleeve 304. The reinforcement panel of the inner sleeve 328 wraps around the end of the inner sleeve 304 so that the edges of the closed end of the outer sleeve 302 are rounded (rather than square), which prevents tampering of the packaging apparatus.

As shown in FIGS. 3A and 3B, the locking tab of the inner sleeve 316 and the locking ridge 322 are both arc-shaped. When the packaging apparatus 300 is assembled and in a closed configuration with the inner sleeve 304 entirely inserted into in the outer sleeve 302, the arc-shaped end of the locking tab of the inner sleeve 316 and the arc-shaped end of the locking ridge 322, which are inverse cut-outs of each other, nest opposite one another and together are fighting edges that lock the packaging apparatus 300.

Figure 4A:
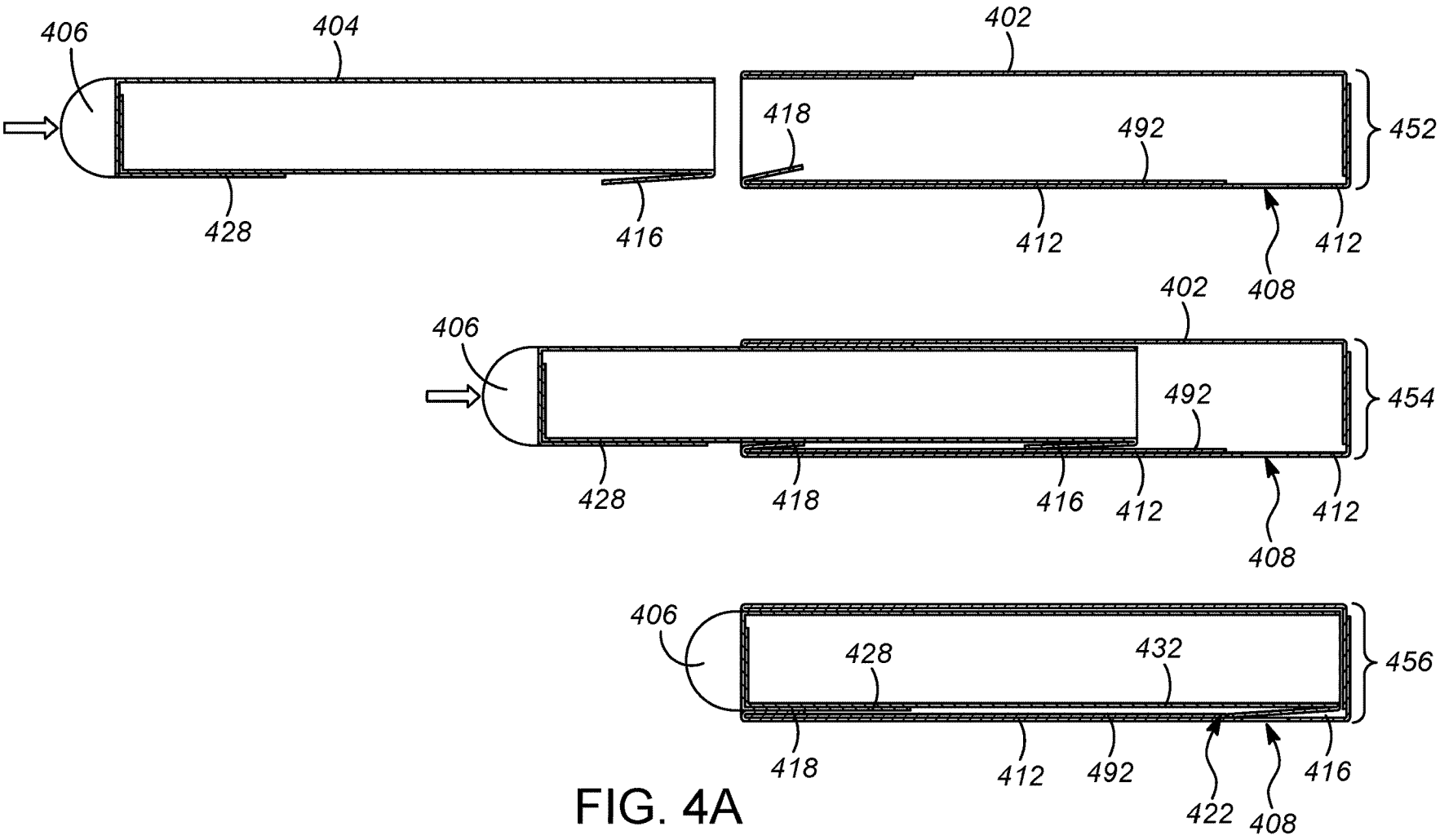
FIGS. 4A and 4B illustrates side cross-sectional views of an example packaging apparatus during assembly and use.
Figure 4B:
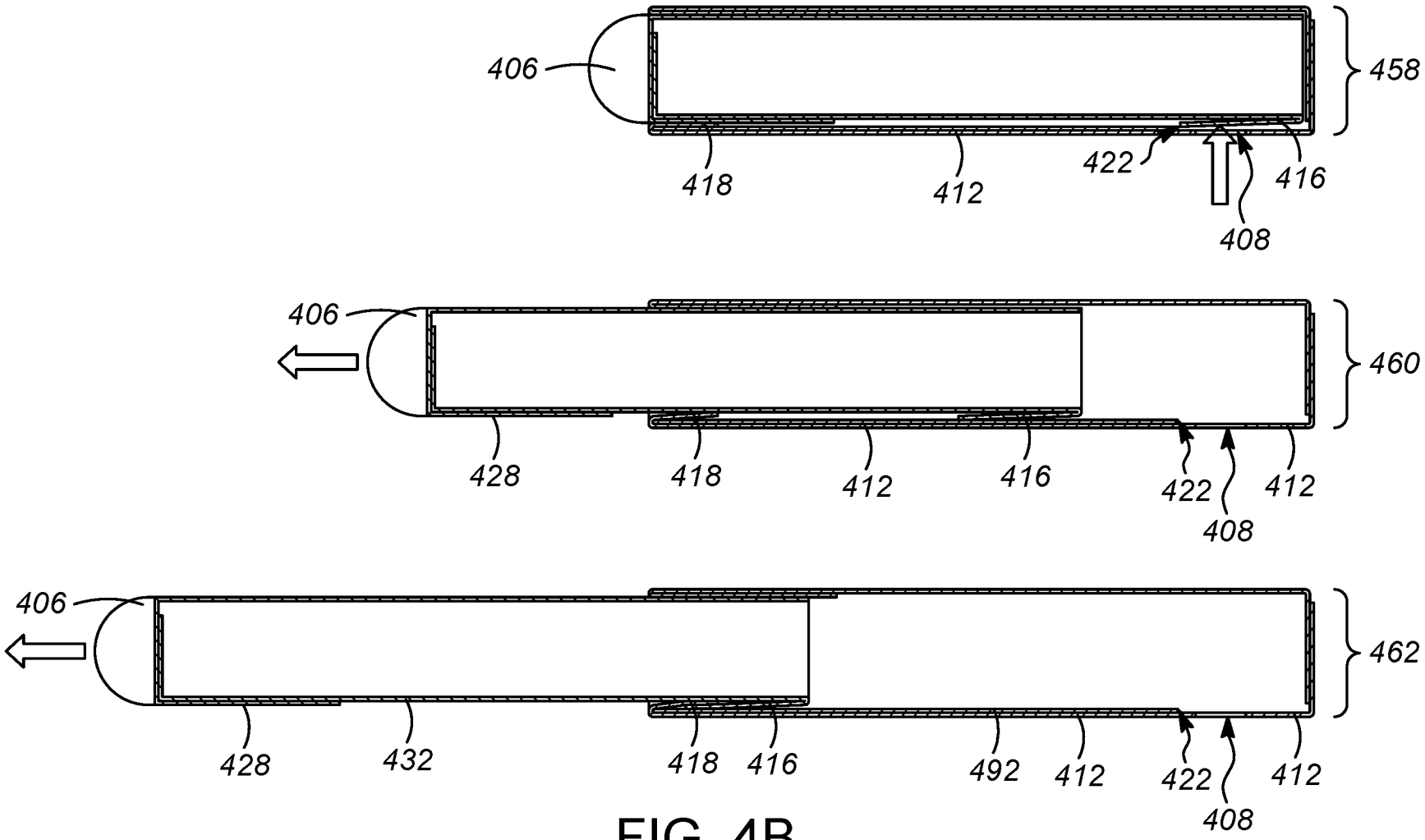

FIGS. 4A and 4B illustrate side cross-sectional views of an example packaging apparatus during various steps 452-462 of assembly and use. In a step 452, the inner sleeve 404 is shown detached from the outer sleeve 402 prior to assembly of the packaging apparatus 400. Prior to inserting the inner sleeve 404 into the outer sleeve 402 to assemble the packaging apparatus 400, the locking tab on the inner sleeve 416 may be positioned approximately adjacent or substantially parallel to the exterior surface of the bottom panel 432 of the inner sleeve 404. The locking tab of the outer sleeve 418 may be pushed inside the outer sleeve 402 and positioned approximately adjacent or substantially parallel to the first glue lap 492 located on the interior surface of a bottom panel 412 of the outer sleeve 402. In a step 454, the inner sleeve 404 is shown partially inserted into the outer sleeve 402, where when the inner sleeve 404 enters the outer sleeve 402, the locking tab on the inner sleeve 416 stays positioned approximately adjacent or substantially parallel to the exterior surface of the bottom panel 432 of the inner sleeve 404 and the locking tab of the outer sleeve 418 stays positioned approximately adjacent or substantially parallel to the first glue lap 436 located on the interior surface of a bottom panel 412 of the outer sleeve 402.

In a step 456, the inner sleeve 404 is shown entirely inserted into the outer sleeve 402 in a locked position. The locking tab on the inner sleeve 416, which has moved past the first glue lap 436 of the outer sleeve 404, springs into an area (shown in greater detail in FIG. 5) in the outer sleeve 402 adjacent the interior surface of a bottom panel 412 of the outer sleeve 402 due to its memory properties. Once the locking tab on the inner sleeve 416 moves past the first glue lap 436, the locking tab on the inner sleeve 416 locks onto a locking edge 422 on the glue lap 436. As a result, the inner sleeve 404 is locked inside the outer sleeve 402.

In a step 458, the inner sleeve 404 is shown entirely inserted into the outer sleeve 402 in an unlocked position. Specifically, a user can apply pressure to the locking tab on the inner sleeve 416 by inserting either a thumb, finger, key, or other instrument through the aperture 408 located in the bottom panel 412 of the outer sleeve 402 and push the locking tab on the inner sleeve 416 upward into the interior of outer sleeve 402 past the locking edge 422.

Once the locking tab on the inner sleeve 416 clears the locking edge 422, the inner sleeve 402 can be pulled by the pull tab 406 from the outer sleeve 402, opening the packaging apparatus 400. As shown in step 460, the inner sleeve 404 is shown partially pulled out of the outer sleeve 402 in an unlocked position. A user can access contents inside the inner sleeve 404 when the inner sleeve is partially pulled out of the outer sleeve 402.

As the user continues to pull the inner sleeve 404 from the outer sleeve 402, the locking tab on the inner sleeve 416, which is facing in a direction opposite the direction that the locking tab of the outer sleeve 418 is facing, catches on the locking tab of the outer sleeve 418. Specifically, the end of the locking tab 416 slides in between the locking tab of the outer sleeve 418 and the middle panel of the outer sleeve 492 and hooks proximate to the interface where the end of the locking tab of the outer sleeve 418 is connected to the bottom panel of the outer sleeve 412 and adjacent to the middle panel of the outer sleeve 492. As a result, the opposing locking tabs lock against each other, and the inner sleeve 404 is prevented from being entirely pulled out of the outer sleeve 402. The inner sleeve 404 is shown partially pulled out of the outer sleeve 402 in a locked position in a step 462.

Figure 5A:
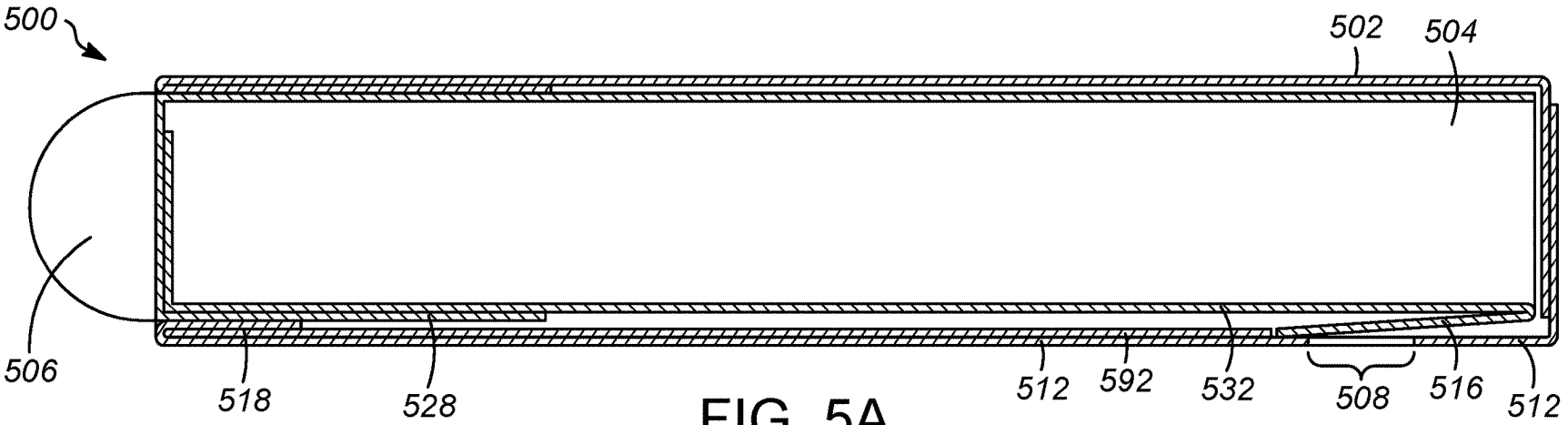
FIGS. 5A and B illustrate two enlarged side cross-sectional view of an example packaging apparatus during use.
Figure 5B:
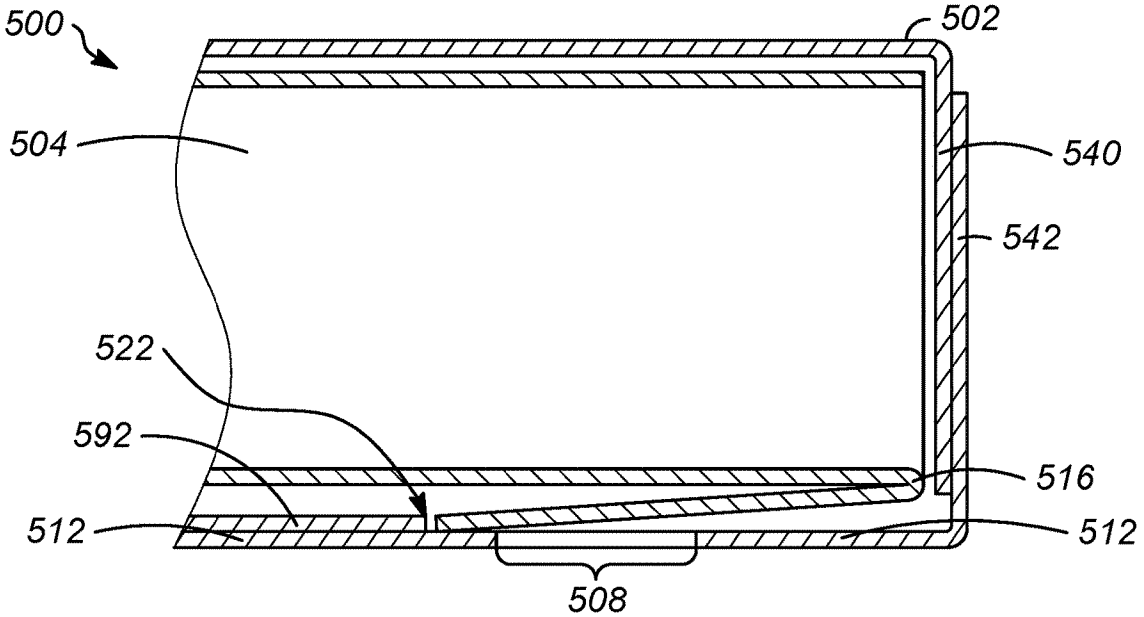

FIGS. 5A and 5B illustrate enlarged, side cross-sectional views of an example packaging apparatus during use in step 456 of FIG. 4, where the packaging apparatus is in a closed configuration by the first locking mechanism. The inner sleeve 504 is shown entirely inserted into the outer sleeve 502 in a locked position. The locking tab on the inner sleeve 516, has moved past the first glue lap 592 of the outer sleeve 504, into an area in the outer sleeve 502 adjacent the interior surface of a bottom panel 512 of the outer sleeve 502 because of its memory properties. The locking tab on the inner sleeve 516 has moved past the first glue lap 536 and locked onto a locking edge 522 on the glue lap 592. As a result, the inner sleeve 504 is locked inside the outer sleeve 502.

To unlock the packaging apparatus 500, a user presses down on the locking tab of the inner sleeve 516 via the aperture 508 and pushes the locking tab 516 into the outer sleeve, disengaging the locking tab of the inner sleeve 516 from the locking edge 522. The inner sleeve can then be pulled from the outer sleeve by the pull tab 506.

Figure 6:
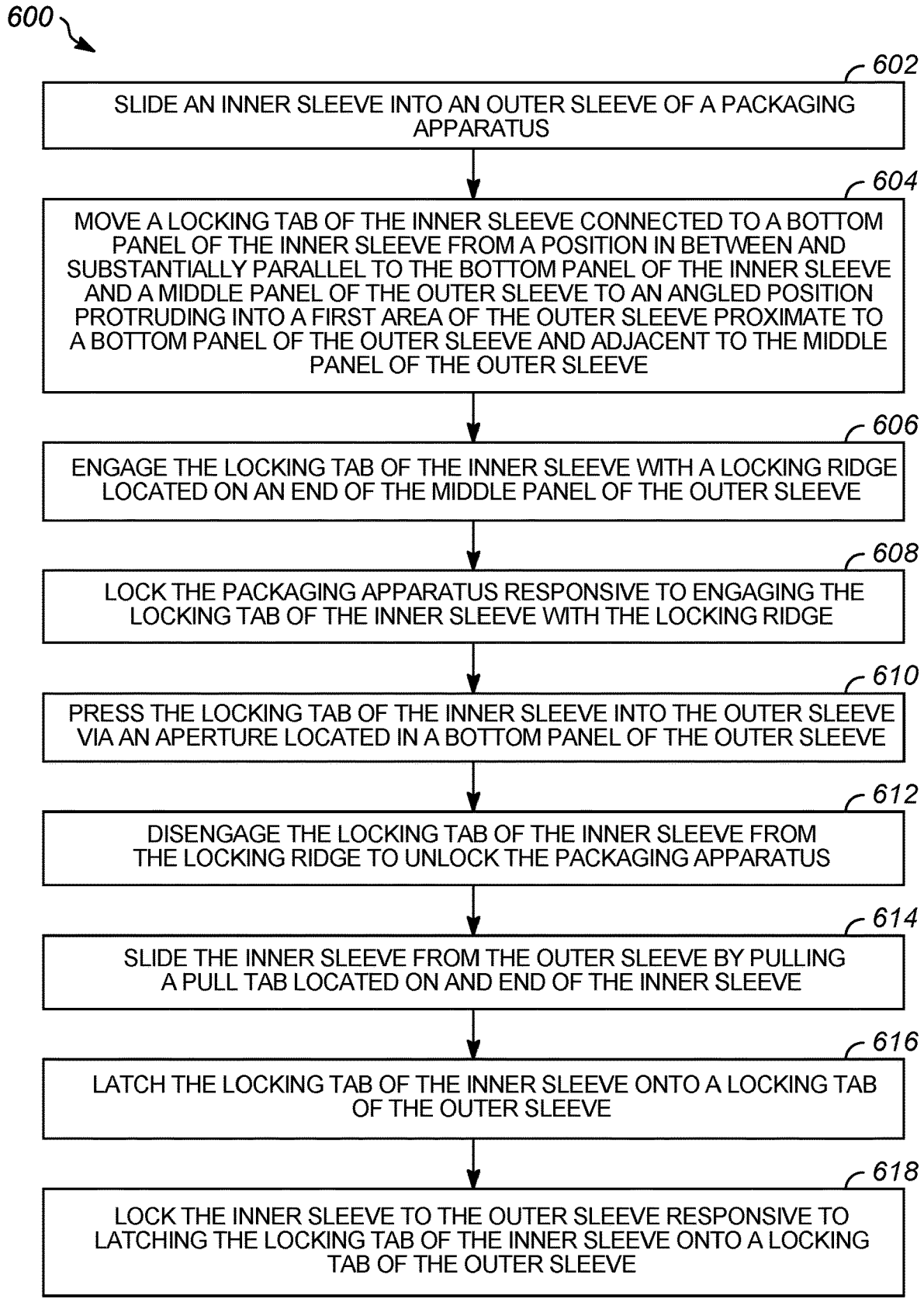
FIG. 6 is a flowchart of example operations of using a packaging apparatus.

FIG. 6 is a flowchart of example operations 600 during use of the packaging apparatus. An operation 602 slides an inner sleeve into an outer sleeve of a packaging apparatus. In some implementations, the inner sleeve may be partially inside the outer sleeve during operation 602. In other implementations, if the inner sleeve is not yet inside the outer sleeve, a user can fold a locking tab of the outer sleeve located on an end of the bottom panel of the outer sleeve into the outer sleeve and to a position substantially parallel to a surface of a middle panel (or glue lap) of the outer sleeve attached the interior surface of the bottom panel of the outer sleeve, and fold a locking tab of the inner sleeve located on an end of the bottom panel of the inner sleeve around to a position substantially parallel to an exterior surface of the bottom panel of the inner sleeve before sliding the inner sleeve into the outer sleeve.

As the inner sleeve enters the outer sleeve in operation 602, the locking tab of the inner sleeve remains substantially parallel to the bottom panel of the inner sleeve An operation 604 moves a locking tab of the inner sleeve connected to an end of a bottom panel of the inner sleeve from a position in between and substantially parallel to the bottom panel of the inner sleeve and a middle panel of the outer sleeve to an angled position protruding into a first area of the outer sleeve proximate to a bottom panel of the outer sleeve and adjacent to the middle panel of the outer sleeve.

An operation 606 engages the locking tab of the inner sleeve with a locking ridge located on an end of the middle panel of the outer sleeve. An operation 608 locks the packaging apparatus responsive to engaging the locking tab of the inner sleeve with the locking ridge.

An operation 610 presses the locking tab of the inner sleeve into the outer sleeve via an aperture located in a bottom panel of the outer sleeve. An operation 612 disengages the locking tab of the inner sleeve from the locking ridge to unlock the packaging apparatus.

An operation 614 slides the inner sleeve from the outer sleeve. An operation 616 latches the locking tab of the inner sleeve onto a locking tab of the outer sleeve. An operation 618 locks the inner sleeve to the outer sleeve responsive to latching the locking tab of the inner sleeve onto a locking tab of the outer sleeve. In some implementations, the locking tab of the inner sleeve and the locking tab of the outer sleeve are angled in opposing directions.

The above specification, examples, and data provide a complete description of the structure and use of exemplary embodiments of the disclosed technology. Since many embodiments of the disclosed technology can be made without departing from the spirit and scope of the disclosed technology, the disclosed technology resides in the claims hereinafter appended. Furthermore, structural features of the different embodiments may be combined in yet another embodiment without departing from the recited claims.

What is claimed is:

1. A packaging apparatus comprising:

an inner sleeve;

an outer sleeve comprising a bottom panel of the outer sleeve, a top panel of the outer sleeve, a middle panel of the outer sleeve, a locking tab of the outer sleeve, a first side panel of the outer sleeve, and a second side panel of the outer sleeve, wherein, in an unassembled configuration, the bottom panel of the outer sleeve is attached to the first side panel of the outer sleeve, the first side panel of the outer sleeve is attached to the top panel of the outer sleeve, the top panel of the outer sleeve is attached to the second side panel of the outer sleeve, the middle panel of the outer sleeve attached to the second side panel of the outer sleeve, the locking tab of the outer sleeve is attached to the bottom panel of the outer sleeve, and the top panel, the first side panel, and the second side panel separate and are positioned between the middle panel of the outer sleeve and the bottom panel of the outer sleeve, wherein the bottom panel of the outer sleeve has a bottom panel length and a length of at least a portion of the middle panel of the outer sleeve is equal to the bottom panel length; and wherein, in an assembled configuration, the middle panel of the outer sleeve forming a glue lap that is glued to the bottom panel of the outer sleeve; and a first locking mechanism of the packaging apparatus comprising the middle panel of the outer sleeve and configured to lock the inner sleeve inside the outer sleeve responsive to sliding the inner sleeve inside the outer sleeve, wherein:

a locking tab of the inner sleeve connected to an end of a bottom panel of the inner sleeve is configured to:

move from a position in between and substantially parallel to the bottom panel of the inner sleeve and the middle panel of the outer sleeve to an angled position protruding into a first area of the outer sleeve proximate to an end panel of the bottom sleeve and the bottom panel of the outer sleeve and adjacent to the middle panel of the outer sleeve; and engages with a locking ridge located on an end of the middle panel of the outer sleeve; and a second locking mechanism of the packaging apparatus configured to lock the inner sleeve to the outer sleeve responsive to sliding the inner sleeve from the outer sleeve until the locking tab of the inner sleeve latches onto the locking tab of the outer sleeve, the locking tab of the inner sleeve and the locking tab of the outer sleeve angled in opposing directions.

2. The packaging apparatus of claim 1, wherein the edge of the locking ridge and edge of the locking tab of the inner sleeve are arc-shaped and the edge of the locking ridge and edge of the locking tab of the inner sleeve are configured to oppose one another to form the first locking mechanism.

3. The packaging apparatus of claim 1, further comprising:

an aperture located on the bottom panel of the outer sleeve wherein a user can access the locking tab of the inner sleeve when the inner sleeve is positioned inside the outer sleeve in a closed configuration.

4. The packaging apparatus of claim 3, wherein the user can press the locking tab of the inner sleeve into the outer sleeve via the aperture and disengage the locking tab of the inner sleeve from the locking ridge to unlock the packaging apparatus.

5. The packaging apparatus of claim 4, wherein the second locking mechanism prevents the inner sleeve from sliding entirely out of the outer sleeve.

6. The packaging apparatus of claim 4, wherein the second locking mechanism locks the inner sleeve partially inside the outer sleeve.

7. The packaging apparatus of claim 1, further comprising a storage compartment located in the inner sleeve.

8. The packaging apparatus of claim 1, wherein the top panel of the inner sleeve comprises a perforated top panel in a storage compartment that may be pressed into the storage compartment to receive and hold a storage item in place.

9. The packaging apparatus of claim 1, further comprising:

a pull tab for removal of the inner sleeve from inside the outer sleeve.

10. The packaging apparatus of claim 1, further comprising:

a permanently fixed dog-eared tuck located on an end of the outer sleeve.

11. The packaging apparatus of claim 1, wherein the first locking mechanism locks the inner sleeve in its entirety inside the outer sleeve.

12. A packaging apparatus comprising:

an inner sleeve, including:

a bottom panel of the inner sleeve;

a top panel of the inner sleeve;

at least one side panel of the inner sleeve;

a middle panel of the inner sleeve;

a storage compartment of the inner sleeve; and a locking tab of the inner sleeve;

wherein, in an unassembled configuration, the at least one side panel of the inner sleeve is attached to the top panel of the inner sleeve and the middle panel of the inner sleeve is attached to the at least one side panel of the inner sleeve;

wherein, in an assembled configuration, the middle panel of the inner sleeve and the bottom panel of the inner sleeve at least partially define the storage compartment of the inner sleeve;

an outer sleeve, including:

a bottom panel of the outer sleeve, a top panel of the outer sleeve, a middle panel of the outer sleeve, a locking tab of the outer sleeve, a first side panel of the outer sleeve, and a second side panel of the outer sleeve, wherein, in an unassembled configuration, the bottom panel of the outer sleeve attached to the first side panel of the outer sleeve, the first side panel of the outer sleeve attached to the top panel of the outer sleeve, the top panel of the outer sleeve attached to the second side panel of the outer sleeve, the middle panel of the outer sleeve attached to the second side panel of the outer sleeve, the locking tab of the outer sleeve is attached to the bottom panel of the outer sleeve, and the top panel, the first side panel, and the second side panel separate and are positioned between the middle panel and the bottom panel, wherein, in an assembled configuration, the middle panel of the outer sleeve forming a glue lap that is glued to the bottom panel of the outer sleeve;

an aperture located on the bottom panel of the outer sleeve wherein a user can access the locking tab of the inner sleeve when the inner sleeve is positioned inside the outer sleeve in a closed configuration; and a first locking mechanism of the packaging apparatus comprising the middle panel of the outer sleeve and configured to lock the inner sleeve inside the outer sleeve responsive to sliding the inner sleeve inside the outer sleeve, wherein:

the locking tab of the inner sleeve connected to a bottom panel of the inner sleeve is configured to:

move from a position in between and substantially parallel to the bottom panel of the inner sleeve and the middle panel of the outer sleeve to an angled position protruding into a first area of the outer sleeve proximate to the bottom panel of the outer sleeve and adjacent to the middle panel of the outer sleeve; and engages with a locking ridge located on an end of the middle panel of the outer sleeve; and a second locking mechanism of the packaging apparatus configured to lock the inner sleeve to the outer sleeve responsive to sliding the inner sleeve from the outer sleeve with the pull tab located on the end of the inner sleeve until the locking tab of the inner sleeve latches onto the locking tab of the outer sleeve, the locking tab of the inner sleeve and the locking tab of the outer sleeve angled in opposing directions.

13. The packaging apparatus of claim 12, wherein the edge of the locking ridge and edge of the locking tab of the inner sleeve are arc-shaped and the edge of the locking ridge and edge of the locking tab of the inner sleeve are configured to oppose one another to form the first locking mechanism.

14. The packaging apparatus of claim 12, wherein the user can press the locking tab of the inner sleeve into the outer sleeve via the aperture and disengage the locking tab of the inner sleeve from the locking ridge to unlock the packaging apparatus.

15. A packaging apparatus comprising:

an inner sleeve comprising a bottom panel of the inner sleeve, a top panel of the inner sleeve, a first side panel of the inner sleeve, a second side panel of the inner sleeve, a middle panel of the inner sleeve, a locking tab of the inner sleeve, a first compartment side panel of the inner sleeve, two compartment top panels of the inner sleeve, and a second compartment side panel, wherein, in an unassembled configuration, the bottom panel of the inner sleeve is attached to the first side panel of the inner sleeve, the first side panel of the inner sleeve is attached to the top panel of the inner sleeve, the top panel of the inner sleeve is attached to the second side panel of the inner sleeve, the middle panel of the inner sleeve attached to the second side panel of the inner sleeve, the locking tab of the inner sleeve is attached to the bottom panel of the outer sleeve, the first compartment side panel of the inner sleeve is attached to the middle panel of the inner sleeve, the two compartment top panels of the inner sleeve are attached to the first compartment side panel of the inner sleeve, and the second compartment side panel of the inner sleeve is attached to the two compartment top panels of the inner sleeve, wherein, in an assembled configuration, the middle panel of the inner sleeve is attached to the bottom panel of the inner sleeve and the bottom panel of the inner sleeve, the middle panel of the inner sleeve, the two compartment top panels of the inner sleeve, the first compartment side panel of the inner sleeve, and the second compartment side panel of the inner sleeve at least partially define an inner compartment of the inner sleeve;

an outer sleeve comprising a bottom panel of the outer sleeve, a top panel of the outer sleeve, a middle panel of the outer sleeve, a locking tab of the outer sleeve, a first side panel of the outer sleeve, and a second side panel of the outer sleeve, wherein, in an unassembled configuration, the bottom panel of the outer sleeve is attached to the first side panel of the outer sleeve, the first side panel of the outer sleeve is attached to the top panel of the outer sleeve, the top panel of the outer sleeve is attached to the second side panel of the outer sleeve, the middle panel of the outer sleeve is attached to the second side panel of the outer sleeve, the locking tab of the outer sleeve is attached to the bottom panel of the outer sleeve, and the top panel, the first side panel, and the second side panel separate and are positioned between the middle panel and the bottom panel, wherein, in an assembled configuration, the middle panel of the outer sleeve forming a glue lap that is glued to the bottom panel of the outer sleeve; and a first locking mechanism of the packaging apparatus comprising the middle panel of the outer sleeve and configured to lock the inner sleeve inside the outer sleeve responsive to sliding the inner sleeve inside the outer sleeve, wherein:

the locking tab of the inner sleeve connected to an end of a bottom panel of the inner sleeve is configured to:

move from a position in between and substantially parallel to the bottom panel of the inner sleeve and the middle panel of the outer sleeve to an angled position protruding into a first area of the outer sleeve proximate to an end panel of the bottom sleeve and the bottom panel of the outer sleeve and adjacent to the middle panel of the outer sleeve; and engages with a locking ridge located on an end of the middle panel of the outer sleeve; and a second locking mechanism of the packaging apparatus configured to lock the inner sleeve to the outer sleeve responsive to sliding the inner sleeve from the outer sleeve until the locking tab of the inner sleeve latches onto the locking tab of the outer sleeve, the locking tab of the inner sleeve and the locking tab of the outer sleeve angled in opposing directions.

16. The packaging apparatus of claim 15, wherein the edge of the locking ridge and edge of the locking tab of the inner sleeve are arc-shaped and the edge of the locking ridge and edge of the locking tab of the inner sleeve are configured to oppose one another to form the first locking mechanism.

17. The packaging apparatus of claim 15, further comprising:

an aperture located on the bottom panel of the outer sleeve wherein a user can access the locking tab of the inner sleeve when the inner sleeve is positioned inside the outer sleeve in a closed configuration.

18. The packaging apparatus of claim 17, wherein the user can press the locking tab of the inner sleeve into the outer sleeve via the aperture and disengage the locking tab of the inner sleeve from the locking ridge to unlock the packaging apparatus.

19. The packaging apparatus of claim 18, wherein the second locking mechanism prevents the inner sleeve from sliding entirely out of the outer sleeve.

20. The packaging apparatus of claim 18, wherein the second locking mechanism locks the inner sleeve partially inside the outer sleeve.

* * * * *